United States Patent [19]

Allor, Jr.

[11] 3,995,561

[45] Dec. 7, 1976

[54] CONVEYOR STOP MECHANISM

[75] Inventor: Bernard J. Allor, Jr., Mount Clemens, Mich.

[73] Assignee: Taylor & Gaskin, Inc., Detroit, Mich.

[22] Filed: Apr. 4, 1975

[21] Appl. No.: 565,216

[52] U.S. Cl. ..... 104/172 S; 104/250; 104/252

[51] Int. Cl.[2] ..... B61B 13/00; B65G 17/42; B61K 7/00

[58] Field of Search ..... 104/172 S, 178, 249, 104/250, 252, 89; 198/19, 40, 177 T

[56] References Cited

UNITED STATES PATENTS

| | | | |
|---|---|---|---|
| 3,229,645 | 1/1966 | Deane | 104/172 S |
| 3,434,431 | 3/1969 | Deane | 104/172 S |
| 3,437,054 | 4/1969 | Bishop | 104/178 |
| 3,503,337 | 3/1970 | Haase | 104/172 S |
| 3,559,585 | 2/1971 | Lempio | 104/172 S |
| 3,861,323 | 1/1975 | Turner | 104/250 |

FOREIGN PATENTS OR APPLICATIONS

| | | | |
|---|---|---|---|
| 942,223 | 2/1974 | Canada | 104/172 S |
| 2,100,253 | 9/1971 | Germany | 104/172 S |

*Primary Examiner*—Robert J. Spar
*Assistant Examiner*—Randolph A. Reese
*Attorney, Agent, or Firm*—Burton, Parker & Schramm

[57] ABSTRACT

A power and free conveyor has a stop lug on the carrier body adapted to abut a stop member movable into the path of the carrier along the conveyor track to arrest movement of the carrier, the stop member serving to disengage the driving dog from the power chain prior to abutting the stop lug. The stop lug is spaced rearwardly of the driving dog a distance exceeding rebound of the carrier whereby accidental re-engagement of the driving dog with the power chain is avoided. The stop lug is positioned to engage the power chain pusher lug on a decline in the conveyor system should the hold-back dog fail to do so, thereby preventing a runaway.

6 Claims, 7 Drawing Figures

CONVEYOR STOP MECHANISM

FIELD OF INVENTION

This invention relates to power and free conveyors wherein a plurality of carriers are propelled along a main track by depending pusher lugs on a superjacent conveyor chain engaging upstanding pusher dogs on the carriers. The carriers comprise wheeled trolleys having depending hooks or the like for suspending the loads to be transported. An accumulating lever projecting forwardly of the carriers is raised when a following trolley overtakes a preceding trolley, causing the associated pusher dog to be lowered out of driven engagement with the pusher lug. A hold-back dog spaced rearwardly of the pusher dog is intended to engage the pusher lug to prevent runaway of the carrier on downgrades. A stop lug on the carrier is adapted to engage a stop member positioned along the main track and selectively movable into and out of the path of the pusher dog to depress the same out of engagement with the pusher lug. This invention relates to improvements in the above described mechanism.

BACKGROUND OF THE INVENTION

A power and free conveyor of the type above described is shown in U.S. Pat. No. 3,503,337. A problem has been found to exist during stopping of the carriers in that when a carrier is suddenly arrested by engagement of the stop member with the stop lug on the carrier body, the carrier tends to rebound back away from the stop member and this rebound is sometimes sufficient to allow the pusher dog to be released by the stop member, whereby the next depending pusher lug on the conveyor chain will re-engage the pusher dog once more, propelling the carrier forward and into engagement with the stop member. Thus, a serious bump-and-release-bump-and-release sequence may be initiated which is potentially damaging to the entire conveyor system as it can cause breakage of lugs, dogs, stops, etc. necessitating shutdown of the conveyor system.

Another prior art U.S. Pat. No. 3,437,054 provides a hold-back dog spaced rearwardly of the pusher dog which is intended to engage the stop member and arrest movement of the carrier. However, this structure requires that the main track and the conveyor chain track be spaced vertically farther apart at the stop stations to avoid engagement of the pusher lug with the hold-back dog. In U.S. Pat. No. 3,434,431 the hold-back dog is pivoted on the carrier. I have found this unreliable and noisy during accumulation and on downgrades, respectively.

Accordingly I have discovered that both the rebound problem raised by U.S. Pat. No. 3,503,337 and the problems of the structure shown in U.S. Pat. Nos. 3,437,054 and 3,434,431 may be obviated. My solution is particularly, though not exclusively, appropriate for use with power and free carriers wherein the hold-back dog is enslaved to the pusher dog such that when the latter is depressed by the stop member or otherwise, the hold-back dog is also depressed.

SUMMARY OF THE INVENTION

According to my invention a stop lug is provided on the carrier or trolley body spaced rearwardly from the pusher dog to be engaged by the stop member, the spacing being such as to exceed the rebound of the carrier. In addition, the stop member has a functional width exceeding the distance between the stop lug and pusher dog whereby the stop member will hold the pusher dog depressed during rebound and will also hold the pusher dog depressed while at the same time abutting the rearwardly spaced stop lug. The stop lug projects above the trolley a lesser distance than either the pusher or hold-back dogs and throughout the conveyor system is spaced beneath the pusher lugs on the conveyor chain, except at declines where the main track and conveyor chain tracks are slightly closer together so that should the hold-back dog for any reason not engage the pusher lug, the stop lug will do so and prevent a runaway. In the construction shown the stop lug is spaced rearwardly of both the pusher and hold-back dogs.

As a result of this construction the likelihood of carriers rebounding sufficiently to effect accidental reengagement with the power chain is substantially reduced, the likelihood of a runaway on a downgrade is also substantially reduced if not completely eliminated, and the cost of construction is not increased despite obtaining these desirable results.

BRIEF DESCRIPTION OF PREFERRED EMBODIMENT

Figure 1:
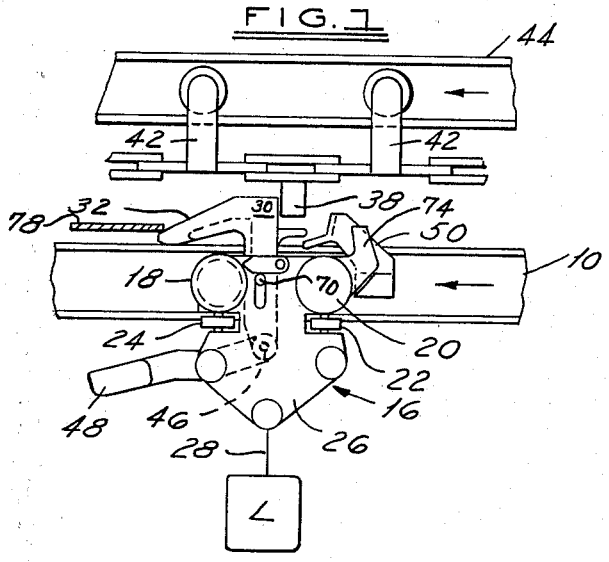
FIGS. 1, 2 and 3 are side elevations, partially in section, through a power and free stop station showing the relationship of the various parts of a typical carrier and stop member embodying the invention and illustrating the sequence of movements.

In the drawings a power and free conveyor is shown having a main conveyor track 10 comprising opposed inwardly opening C-shaped channels 12 and 14 (see FIG. 7) upon which is mounted a carrier 16 supported in the channels by four trolley wheels, two of which are shown at 18 and 20. Lateral guide rollers 22 and 24 engage the peripheral edges of the lower flanges channels 12 and 14.

Each carrier comprises a body 26 upon which the wheels 18–24 are mounted. In addition, the body is provided with a depending hook or other device 28 for suspending the load L to be conveyed, In lieu of a hook per se, a load carrying bar may be provided which is connected to the trolley as by the element 28 and extends rearwardly, or to the right as viewed in FIG. 1, to be connected to a trailing trolley similar to the arrangement shown in my Canadian Patent No. 942,223 issued Feb. 19, 1974. In normal practice there will be a plurality of carriers or trolleys 16 functioning in a power and free conveyor system, and each adapted to carry, either itself or in combination with a trailing trolley, an article or load to be conveyed, In the drawings, (except for FIG. 5) only one trolley is shown, but it is to be understood by those skilled in the art that more than one such trolley is intended.

Each trolley or carrier is provided with a pusher dog 30 having a forwardly facing inclined surface 32 rearwardly terminating in a generally horizontal surface 34. At the rear edge of surface 34 there is a vertically extending pusher lug engaging face 36 adapted to be engaged by a depending pusher lug 38 on a power conveyor chain 40 suspended by rollers and suitable brackets 42 from a conveyor chain track 44 arranged superjacent the main track 10. Reference to my aforementioned Canadian Patent No. 942,223 illustrates the general arrangement of and support for the power chain and its depending pusher lugs. Normally the power chain 40 is provided with a succession of pusher lugs 38 spaced at predetermined distances along the chain and each adapted to engage, selectively, with the pusher dog 32 at its face 36 to propel the carrier along the main track 10.

The pusher dog 30 is supported in the carrier body 26 for vertical shiftable movement between positions of engagement and disengagement with the pusher lugs 38. In a preferred embodiment shown in FIGS. 1, 3 and 5, the pusher dog 30 is pivotally connected at 46, at its lower end, to a forwardly projecting pivotally supported actuating arm 48. When the forward end of actuating arm 48 engages a suitably disposed rearward projection on a preceding trolley, the arm is elevated in a fashion well understood in the art, and thereby causes the pusher dog 30 to be lowered out of engagement with the pusher lug 38 thereby disengaging the carrier from the power chain.

Figure 3:
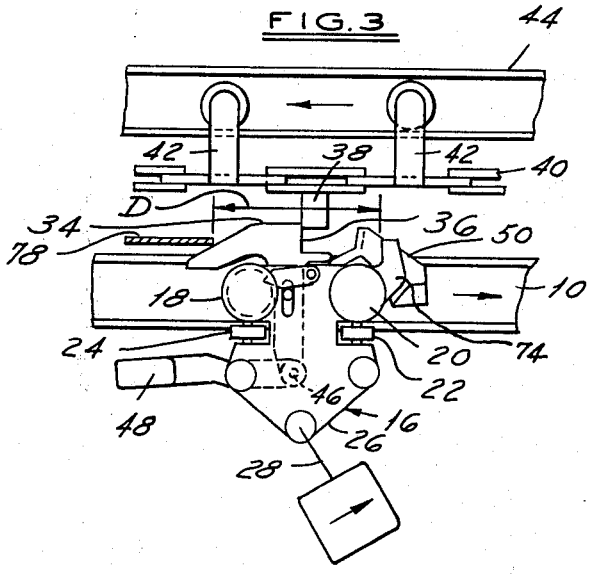
Figure 5:
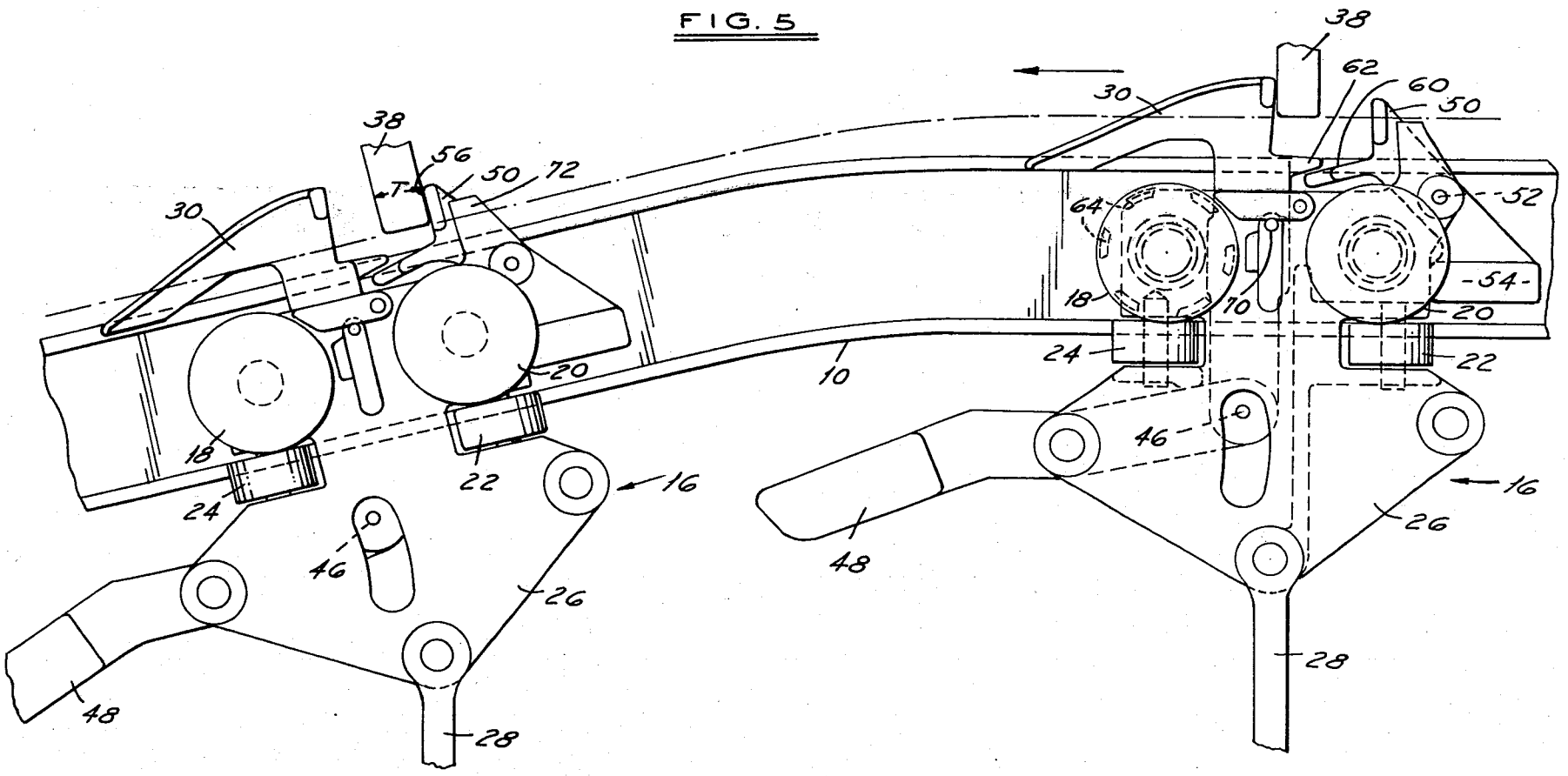
FIG. 5 illustrates a power and free conveyor embodying my invention showing a carrier just prior to and during movement through a downgrade.

In the embodiment of the invention shown herein, there is also a hold-back dog 50 pivotally mounted at 52 on the carrier body and counterweighted at 54 so that the dog normally assumes the position shown in FIGS. 1, 3 and 5. The dog has a forwardly directed face 56 adapted to engage the trailing face 58 of the pusher lug 38 to prevent the trolley from overrunning the lug. Such a condition may occur during a downgrade or decline section of the conveyor shown at the left in FIG. 5.

Figure 4:
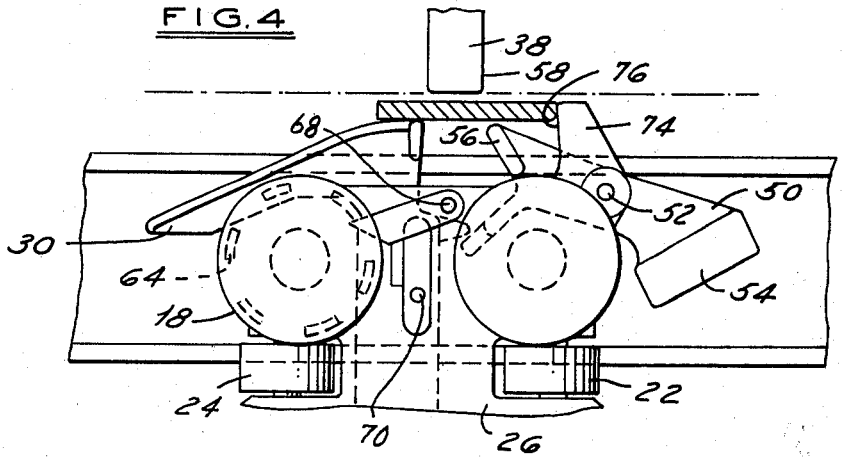
FIG. 4 is a view similar to FIG. 2 taken substantially on the line 4—4 of FIG. 6.

In the construction shown herein this hold-back dog is provided with a forwardly extending finger 60, see FIG. 5, which underlies a rearwardly projecting and cooperating finger 62 on the pusher dog whereby upon lowering of the pusher dog the hold-back dog will be similarly lowered and such is shown in FIG. 4 wherein the hold-back dog has been pivoted counter-clockwise a distance such that it projects above the carrier less than does the pusher dog.

The carrier is also optionally but preferably provided with anti-rebound mechanism in the form of wheel abutments 64 on the front trolley wheels 18 which are selectively engaged by a pawl 66 pivotally mounted at 68 on the carrier body. A laterally projecting pin 70 on the pusher dog engages beneath the pawl 66 and holds it out of contact with the abutments 64 when the pusher dog 30 is in its operative engaged position with the pusher lug 38 but when the pusher dog is lowered out of engagement with the pusher lug, the pin 70 descends and allows the pawl 66 to engage the abutments to dampen rebound movement of the trolley upon it suddenly being arrested during its forward travel. The construction and arrangement of this anti-rebound mechanism is more fully disclosed in my aforementioned Canadian Patent No. 942,223.

On occasion I have found that during movement of the carriers through a downgrade, as shown in FIG. 5, the hold-back dog 50 fails to engage the pusher lug 38 resulting in a runaway condition. To avoid this I have provided a secondary hold-back means comprising a pair of upstanding stop lugs 72 and 74 intrigal with the carrier body 26 and having forwardly directed faces 76 for engaging the trailing side of the pusher lug 38. As these secondary lugs are immovably fixed on the carrier body, they will provide a positive engagement with the pusher lug during a downgrade in the conveyor system.

Normally the main tracks 10 and the chain conveyor track are spaced apart such that the lower end of the pusher lug 38 will be spaced above the upper end of the secondary lugs 72 and 74 as shown in FIGS. 1–4. However, in the area of a downgrade or decline in the conveyor system the main track and conveyor chain track are spaced slightly closer together so that the lower end of the pusher lug 38 will extend below the upper end of the secondary lugs 72 and 74 whereby the same may be engaged in the event of a failure of the hold-back dog 50 to engage the pusher lug. This capability is illustrated in FIG. 5.

In addition to serving as a secondary hold-back, the lugs 72 and 74 perform a further important function now to be described and in this regard and in the claims appended hereto are referred to as stop lugs rather than secondary hold-back lugs. It is conventional in power and free systems to provide some means for arresting forward movement of the carriers at preselected points during their travel through the conveyor system. These points are referred to herein as stop stations. In the disclosed embodiment the stop station includes a stop member in the form of a horizontally disposed blade 78 shown in various figs. of the drawings. This stop member is supported for rectilinear motion across the path of travel of the carriers. The balde is supported on the top of a box-like structure 80 which is welded as at 82 to the side of the main track 10. Within the box is disposed a fluid pressure cylinder 84 which is rigidly secured to an upper wall 86 of the box by bolts 88. The bolts pass through spacer elements overlying the top wall 86, which spacer elements support a retainer plate 90 in spaced relation above the top wall 86 to provide a guideway for the blade 78. In addition, the spacer elements overlie opposite side edges 92 and 94 of the blade to guide it in its rectilinear motion. The piston rod 96 is connected at 98 to a depending flange 100 welded to the blade 78 and reinforced by web elements 102. Upon pressurization of the cylinder at one or the other of its ends, the blade is shifted between positions extending across the main track as shown in FIGS. 6 and 7 to a position retracted out of the path of travel of a carrier on the track.

Figure 6:
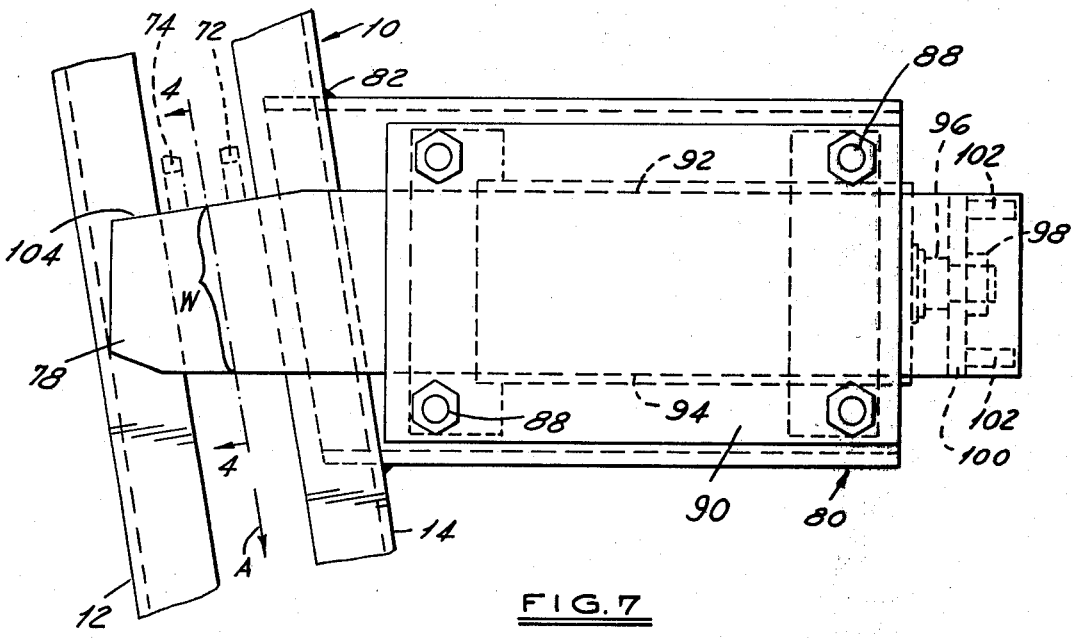
FIG. 6 is a plan view of a stop positioned along the main conveyor track for arresting movement of a carrier.
Figure 7:
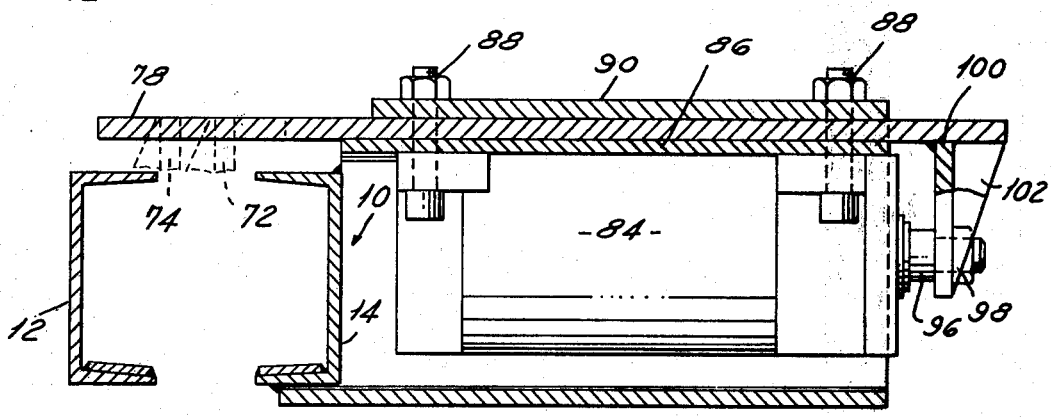
FIG. 7 is a side elevation partly in section of the stop shown in FIG. 6.

When the blade 78 is extended as shown in FIGS. 6 and 7, it is in a position to engage the inclined caming face or surface 32 of the pusher dog 30 to cam the dog downwardly out of engagement with the pusher lug 38. In FIG. 1 the blade is shown just as it contacts the caming surface 32 of the pusher dog while in FIG. 2 the carrier has shifted further forward to cause the blade to depress the pusher dog and the blade now overlies the upper surface 34 of the dog holding it in the depressed condition. At the same time the upstream edge 104 of the stop member is shown as abutting the forwardly directed face 76 of the stop lugs 72 and 74 arresting forward motion of the carrier. Upon retraction of a stop member out of the path of the stop lugs, the pusher dog is permitted to rise by virtue of the gravity action of the actuating arm 48 positioning the dog for engagement with the next pusher lug on the conveyor chain 40 for further movement of the carrier along the track 10.

It will be noted from FIG. 6 that the stop mechanism is secured to the track 10 so that the rectilinear motion of the stop member is oblique to the direction of travel of the carriers indicated by arrow A. It will also be noted that the upstream edge 104 or stopping edge of the stop member is at an angle to the direction of rectilinear motion of the stop member so that edge 104 is perpendicular to the direction of carrier travel and will abut both of the stop lugs 72 and 74 on the carrier. As a result of this inclined or oblique arrangement of the stop mechanism and movement of the stop member, upon retraction of the stop member from the position shown in FIG. 6 to a non-blocking position, the movement of the stop member 78 will be an immediate breakaway of contact with the stop lugs 72 and 74. The importance of this is that if a number of carriers have accumulated behind the one being held by the stop mechanism, there may be substantial forces urging the stop lugs 72 and 74 against the stop member. By the immediate breakaway action afforded by the oblique arrangement above described, retraction of the stop member can be effected more easily as it will not be necessary to drag the surface 104 across the faces 76 of the stop lugs.

An important feature of the construction is that it prevents rebounding of the carrier and accidental re-engagement of the pusher lug 38 with the pusher dog 30. I have discovered that with prior art arrangements, when the carrier stops engage a stop member which has been positioned across the path of carrier movement to abut them and at the same time depress the pusher dog to disengage it from the pusher lug, particularly as shown in U.S. Pat. No. 3,503,337, the sudden arresting of forward movement of the carrier will cause a bounceback of the carrier in the opposite direction from its normal travel and such bounceback is sometimes sufficient to cause the pusher dog to move out from under the stop member allowing the dog to rise and when the next pusher lug on the power chain comes along it engages the pusher dog immediately accelerating the carrier and then just as suddenly the stop member will again depress the pusher dog and effect a disengagement. The result is a severe bump-and-release-bump-and-release sequence which tends to destroy the system. My analysis has led me to the conclusion that this is caused by the magnitude of the forward energy of the load suspended from the carrier at the time of impact of the stop lugs with the stop member. It is the reactionary force caused by the forward energy that causes the trolley or carrier to rebound. Since the reactionary force is directly proportional to the magnitude of the forward energy, if the magnitude of the forward energy can be decreased before impact of the stop member with the stopping lugs, then the rebound problem can be reduced. I have found that by constructing the trolley and stop member as shown herein and above described, the magnitude of the forward energy of the load can be decreased sufficiently before impact of the stop lugs with the stop member so that the reactionary force is substantially reduced.

In addition I have discovered that the reactionary force can be greatly dissipated if the anti-rebound abutments on the trolley wheels are allowed to react with the pawl 66 so that the wheels are locked during all or at least a portion of the rebounding motion of the carrier. Without the abutment and pawl arrangement, the free rolling frictional force during rebounding, such as would be present in the construction shown in U.S. Pat. No. 3,503,337 is only about 1 to 1 and ½ percent of rolling friction force when the trolley is rebounding. On the other hand, if the pawl and abutment engagement is permitted to occur so that sliding friction of the trolley wheels on the main track occurs, there is a thirty percent sliding friction force to overcome or tend to offset the reactionary force during rebounding.

By positioning the stop lugs 72 and 74 rearwardly of the pusher dog, the distance that the carrier must move following disengagement of the pusher dog from the pusher lug provides for a decrease in the magnitude of the forward energy of the load prior to the stop member abutting the stop lugs because during this time the carrier is not powered by the drive chain. Consequently, when the stop member engages the stop lugs there will be a reduction in the magnitude of the forward moving load forces and consequently a reduction in the reactionary force. At the same time, positioning the stop lugs rearwardly of the pusher dog will allow the pawl 66 to engage the abutments 64 of the trolley wheels so that during rebouunding the wheels will be positively locked and will be forced to slide in the main track. The friction created by these sliding wheels will also serve to reduce the reactionary force.

Figure 2:
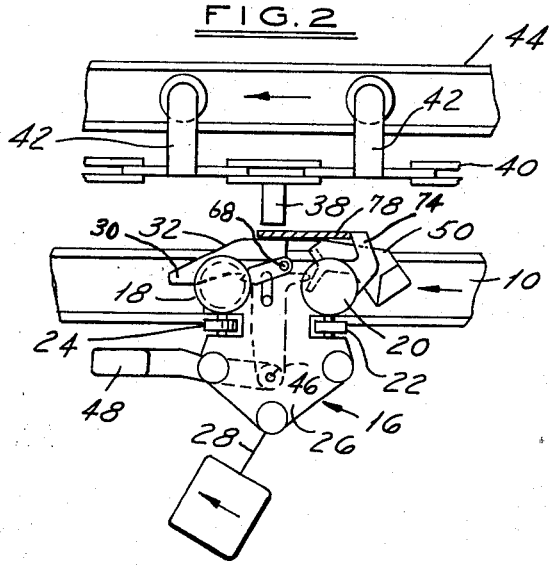

In addition, by positioning the stop lugs rearwardly of the pusher dog, the carrier must rebound a substantial distance before the pusher dog is allowed to rise sufficiently to re-engage the pusher lug. Referring to FIGS. 1–3, in FIG. 1 the carrier is shown moving along the main track 10 under the influence of the pusher lug 38 and the stop member 78 has just contacted the sloping face 32 of the pusher dog. As the carrier continues to move the stop blade will cause the pusher dog to be depressed and at a certain point on the inclined face 32 the stop member will have depressed the dog sufficiently to disengage it from the pusher lug 38. The distance between this point disengagement and the forward faces 76 of the stop lugs is referred to as dimension D shown in FIGS. 1 and 3. As the carrier continues to move it must move the distance equal to dimension D before the stop member engages the stop lugs. During this time the carrier will begin to slow down as a result of rolling friction and the sliding friction of the top member across the inclined face 32 and the upper face 34 of the pusher dog. When the stop member engages the stop lugs, the load L will swing forward as shown in FIG. 2 and the reactionary force is thereupon initiated. In order for the carrier to rebound sufficiently to re-engage the pusher dog with the pusher lug, it must be rebound by the dimension D as shown in FIG. 3. Before it can rebound this far the reactionary force will be dissipated in many cases. With the provision of the pawl 66 and abutment 64, however, the forward trolley wheels 18 will be locked against reverse rotation and will create a sliding friction between the wheels and the track resisting the rebounding motion. When the trolley comes to a stop during rebounding, the load will then swing rearwardly as shown in FIG. 3 tending to shift the trolley in the opposite direction. In order for the pawl and abutment arrangement to be effective, it is necessary to provide sufficient travel during rebounding motion such as that provided by dimension D.

The width of the stop member measured along the center line of the carrier travel and shown at W in FIG. 6 must be sufficient to bridge between the pusher dog and the stop lugs. I have found that if the stop lug 72 and 74 are positioned rearwardly of the rear face 36 of the pusher dog a distance approximately twice the thickness T of the pusher lug, satisfactory operation can be obtained, though it is apparent this distance can be greater, particularly if the pawl and abutment arrangement on the trolley wheels are not utilized and a greater bounceback is to be expected.

What is claimed is:

1. In a conveyor system, the combination comprising:
a main track,
a plurality of carriers movable along said main track,
a conveyor track,
a conveyor movable along said conveyor track,
each of said carriers having a body and a depressable pusher dog with a forwardly facing inclined caming surface,
said conveyor having a pusher lug adapted to engage behind said pusher dog to propel the carriers along the main track,
a hold back dog pivotally mounted on each carrier spaced rearwardly from the pusher dog a distance sufficient to allow forward pivoting of the hold back dog with a pusher lug disposed between the pusher and hold back dogs, means for pivoting the hold back dog forwardly to an inoperative position upon depression of the pusher dog,
a stop member mounted along said conveyor and adapted to be moved into and out of position for engaging and overriding the forwardly facing inclined caming surface of the pusher dog to depress the dog out of engagement with the pusher lug and cause the dog to pass under the stop member,
each carrier body having a stop lug space rearwardly from the pusher and hold back dogs to engage said stop member,
said stop member having a dimension measured longitudinally of the main track exceeding the distance between the pusher dog and the stop lug whereby the stop member will engage the stop lug while continuing to hold the pusher dog depressed,
and said stop lug being spaced rearwardly from the pusher dog a distance exceeding rebound of the carrier upon the stop member engaging the stop lug.

2. The invention defined in claim 1 characterized in that each of said carriers has trolley wheels engaging the main track, at least one of said wheels having anti-rebound means for locking the wheel against reverse movements, and said stop lug being spaced rearwardly from the pusher dog a distance sufficient to allow said anti-rebound means to become operative to lock said trolley wheel.

3. The invention defined by claim 1 characterized in that said stop member is mounted for rectilinear movement across the path of travel of the carriers with the direction of movement being inclined to the direction of movement of the carriers, said stop member having an edge disposed perpendicularly to the direction of movement of the carriers, and said inclined positioning of the member in combination with the perpendicular edge being operable to cause a quick breakaway of such edge of the stop member from a carrier when the stop member is retracted.

4. The invention defined by claim 1 characterized in that a pair of said stop lugs is provided disposed on opposite sides of the carrier body from said pusher dog.

5. The invention defined by claim 1 characterized in that said stop lug projects above the carrier a height exceeding that of the hold-back dog when the same is in its inoperative position.

6. The invention defined by claim 1 characterized in that said main track and said conveyor track are closer together throughout downgrades in the conveyor system whereby said stop lug extends into a position overlapping the pusher lug to prevent accidental runaways in downgrades.

* * * * *